US007731396B2

(12) United States Patent
Fay et al.

(10) Patent No.: US 7,731,396 B2
(45) Date of Patent: Jun. 8, 2010

(54) LED SOCKET STRING

(75) Inventors: Thomas Fay, Rye Brook, NY (US); Jeffrey N. Seward, Fairfax, VT (US)

(73) Assignee: TPR Enterprises, Ltd., Mamaroneck, NY (US)

( * ) Notice: Subject to any disclaimer, the term of this patent is extended or adjusted under 35 U.S.C. 154(b) by 220 days.

(21) Appl. No.: 11/962,938

(22) Filed: Dec. 21, 2007

(65) Prior Publication Data

US 2009/0161372 A1 Jun. 25, 2009

(51) Int. Cl.
*F21V 21/00* (2006.01)

(52) U.S. Cl. ..... 362/391; 362/249.02; 362/249.06

(58) Field of Classification Search ..... 362/249.02, 362/249.03, 249.04, 249.06, 249.07, 249.08, 362/249.14, 267, 391, 653, 654, 800, 806; 439/375, 602, 605, 650, 651, 652, 619, 699.2
See application file for complete search history.

(56) References Cited

U.S. PATENT DOCUMENTS 5,023,762 A * 6/1991 Tieszen ..... 362/249.01
5,375,371 A * 12/1994 Wells ..... 47/81
5,672,000 A * 9/1997 Lin ..... 362/249.06
5,788,362 A * 8/1998 Chou ..... 362/806
5,829,865 A * 11/1998 Ahroni ..... 362/391
7,114,841 B2 * 10/2006 Aanegola et al. ..... 362/249.02
2005/0117339 A1 * 6/2005 Pan ..... 362/391
2007/0159822 A1 * 7/2007 Lin ..... 362/252

* cited by examiner

*Primary Examiner*—Y My Quach Lee
(74) *Attorney, Agent, or Firm*—Venable LLP; Clifton E. McCann; Todd R. Farnsworth

(57) ABSTRACT

An LED socket string with multiple LED sockets and corresponding LED lamps that are spaced on the string unevenly or according to a user specification. Each of the LED sockets includes a socket base with grooves for coupling wires, and a socket cover for mating with the socket base. A lamp holder is integrally mounted onto the socket base for detachably retaining the LED lamp. A lamp spacer can be added to the lamp holder to accommodate the LED lamp.

18 Claims, 6 Drawing Sheets

LED SOCKET STRING

BACKGROUND OF THE INVENTION

1. Field of the Invention

The present invention generally relates to a socket string with light emitting diode (LED) lamps for use in decorative lighting or illumination, one or more LED sockets which can be field installed or sold as parts, and a method for assembling the LED socket string.

2. Description of Related Art

LED light strings are known in the art. An LED light string has a number of discrete LED lamps strung together in series or parallel, and may cover full color spectrum (RGB). Each LED lamp can be controlled individually or collectively to emit light. Generally, the LED lamps in a conventional one string, one circuit model of the LED light string are not RGB.

The LED light strings can be attached to a cloth, or other media such as thin walls, plastic sheets via Velcro, or combined with a drop curtain to present textile backdrops. The LED light strings can have high brightness that is suitable in both dark environments and well-lit spaces.

However, conventional LED light strings are pre-made and do not allow easy replacement of failed LEDs due to normal wear and tear. Additionally, spacing among the LED sockets cannot be adjusted, and the sockets are not designed to allow the mounting of LED light strings onto fabric or hard surfaces.

BRIEF SUMMARY OF THE INVENTION

In an exemplary embodiment, there is provided an LED socket with a socket cover attached to a socket base, and a lamp holder mounted on the socket base for retaining an LED lamp. The LED socket includes a metal plate with one or more pointed portions mounted in the socket base for piercing insulation of the wires, providing an electrical connection between the LED lamp and wires. The socket cover includes snap tabs to facilitate mounting thereof to the socket base, and a pinch guide strain relief for keeping the wires resistant to axial pull while minimizing force required to snap the socket cover to the socket base.

The perimeter of the socket cover can be supplemented with an adhesive to further facilitate installation of the socket cover to the socket base. A lamp spacer can be detachably mounted onto the lamp holder for extending and retaining the LED lamp, and a current control device can be installed on the metal conductors to limit current flow.

The assembly of the LED socket is facilitated through one or more latches at the perimeter of the LED socket. The positioning of each LED socket on the external surface or material is dependent on an adjustable spacing between the sockets. The LED socket can be made from plastic resin or other suitable substitutes.

To secure the LED socket onto an external surface or material, such as fabric or hard surfaces, an adhesive or adhesive backed tape can be applied to one end of the socket cover for attachment thereto. One or more corresponding holes in the socket base and cover can also be used to further facilitate the installation of the LED socket to the external surface or material through, e.g., one or more screws.

In another embodiment, an LED socket string with LED lamps and a plurality of randomly spaced-apart LED sockets is presented. Specifically, the string includes adjustably spaced LED sockets, with each of the LED sockets having a socket base with one or more grooves for coupling one or more wires, and a socket cover for mating with the socket base. A lamp holder is mounted on the socket base for retaining the LED lamp, and the LED socket can be made from plastic resin or other suitable substitutes.

A lamp spacer can be further detachably mounted on the lamp holder for extending and retaining the LED lamp, and a metal plate with one or more pointed portions mounted in the socket base is mounted to pierce the wires and provide an electrical connection between the LED lamp and wires.

Moreover, an adjustable spacing between the LED sockets is determined based on a predefined or user requested specification. The socket cover would include one or more ribs for facilitating mounting thereof to the socket base, and one or more pinch guide for keeping the wires resistant to axial pull while minimizing force required to mount the socket cover to the socket base with the wires therebetween. The end portions of the ribs and a perimeter portion of the socket cover can be supplemented with an adhesive to further facilitate installation of socket cover to the socket base. The positioning of each LED socket on the external surface or material is dependent on an adjustable spacing between the sockets.

To secure the LED socket string onto an external surface or material, such as fabric or hard surfaces, an adhesive can be applied to each socket on the LED socket string. One or more corresponding holes in the socket base and cover can also be used to further facilitate the installation of the LED socket to the external surface or material through, e.g., one or more screws.

In another embodiment, a method of assembling a plurality of LED sockets to form an LED socket string by positioning each of the LED sockets on one or more wires based on an adjustable spacing therebetween, assembling a plurality of socket bases to a plurality of socket covers with the wires affixed therebetween, and securing a plurality of LED lamps to a plurality of lamp holders is presented, wherein each of the lamp holders includes a lamp holder for securing an LED lamp. The adjustable spacing between the LED sockets is determined based on a user specification, and a lamp spacer can be used as a guide for the LED leads and provide further spacing on the lamp holder.

BRIEF DESCRIPTION OF THE DRAWINGS

The foregoing, as well as additional objects, features and advantages of the invention will be more readily apparent from the following detailed description, which proceeds with reference to the accompanying drawings.

The present invention will be discussed in more detail below, using a number of exemplary embodiments, with reference to the attached drawings, in which.

DETAILED DESCRIPTION OF THE INVENTION

Figure 1:
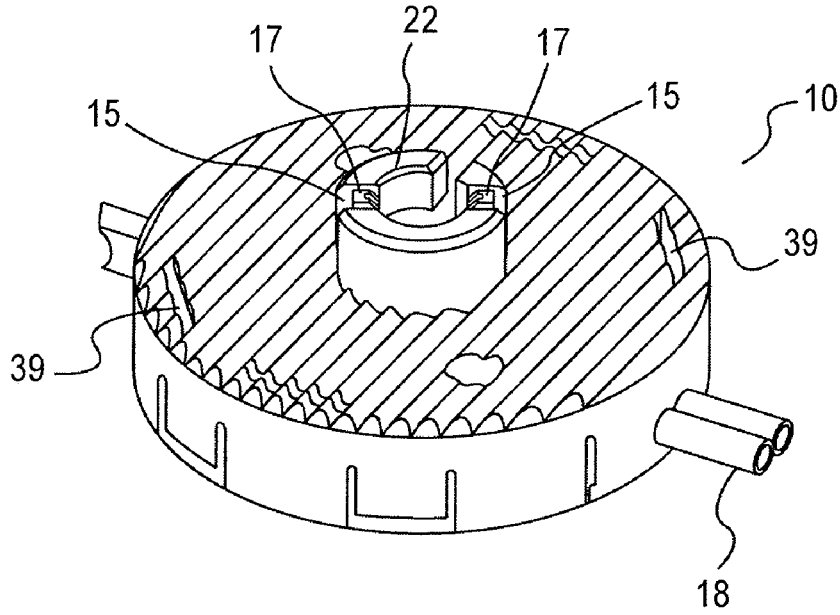
FIG. 1 is an elevated front perspective view of an LCD socket according to one embodiment.
Figure 2:
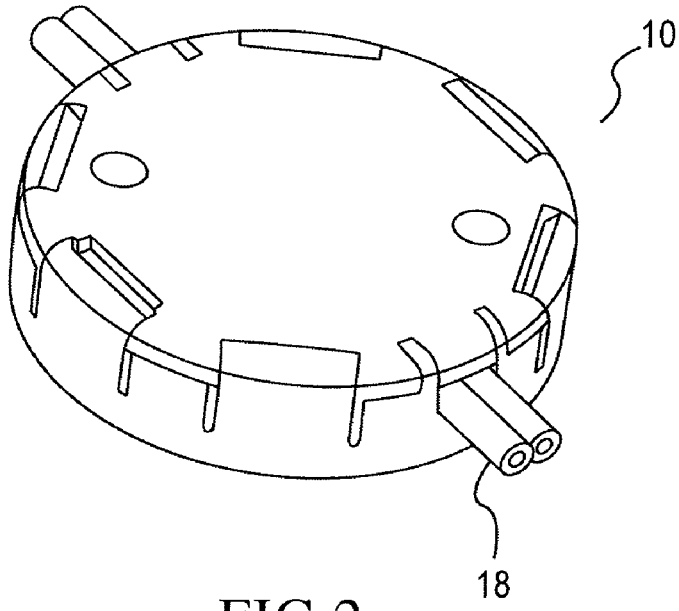
FIG. 2 is an elevated rear perspective view of the LCD socket.
Figure 3:
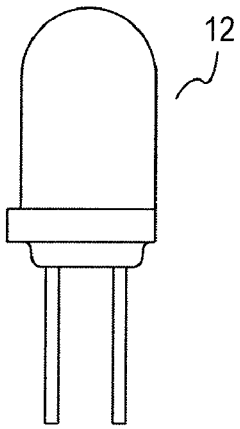
FIG. 3 is a front view of an LED lamp.
Figure 4:
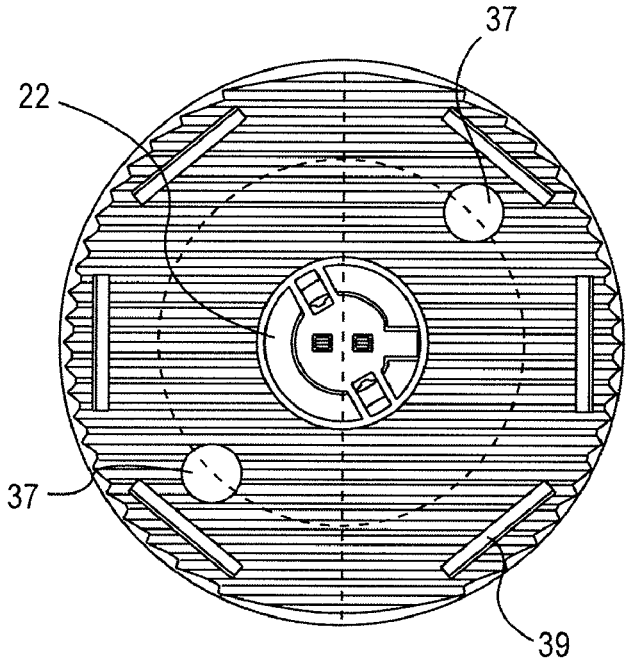
FIG. 4 is a top view of the LCD socket.
Figure 5:
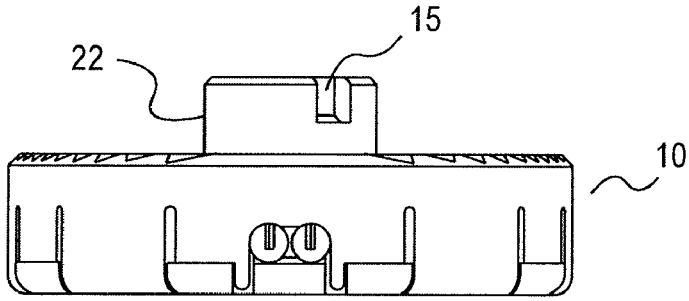
FIG. 5 is a side view of the LCD socket.
Figure 6:
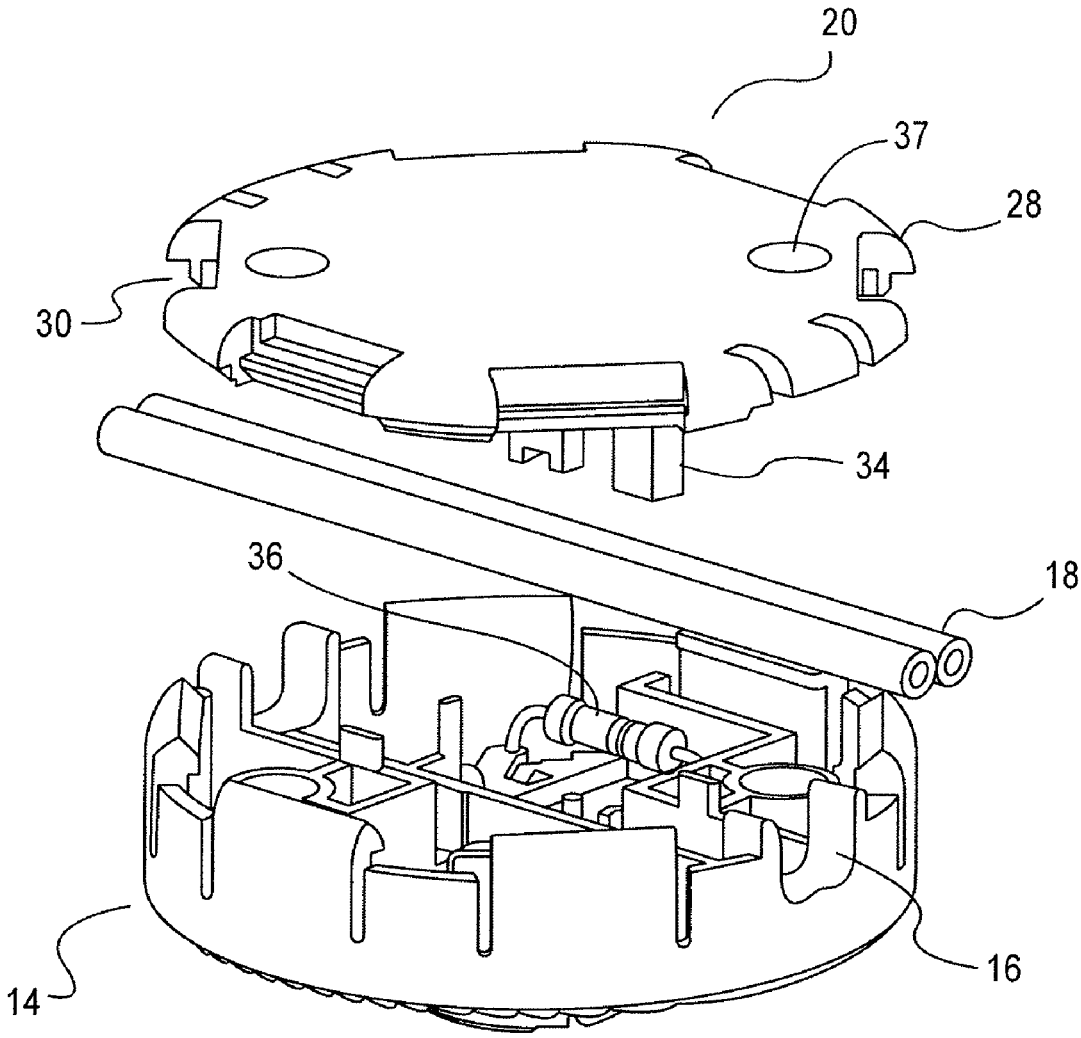
FIG. 6 is an exploded view of the LCD socket.
Figure 7:
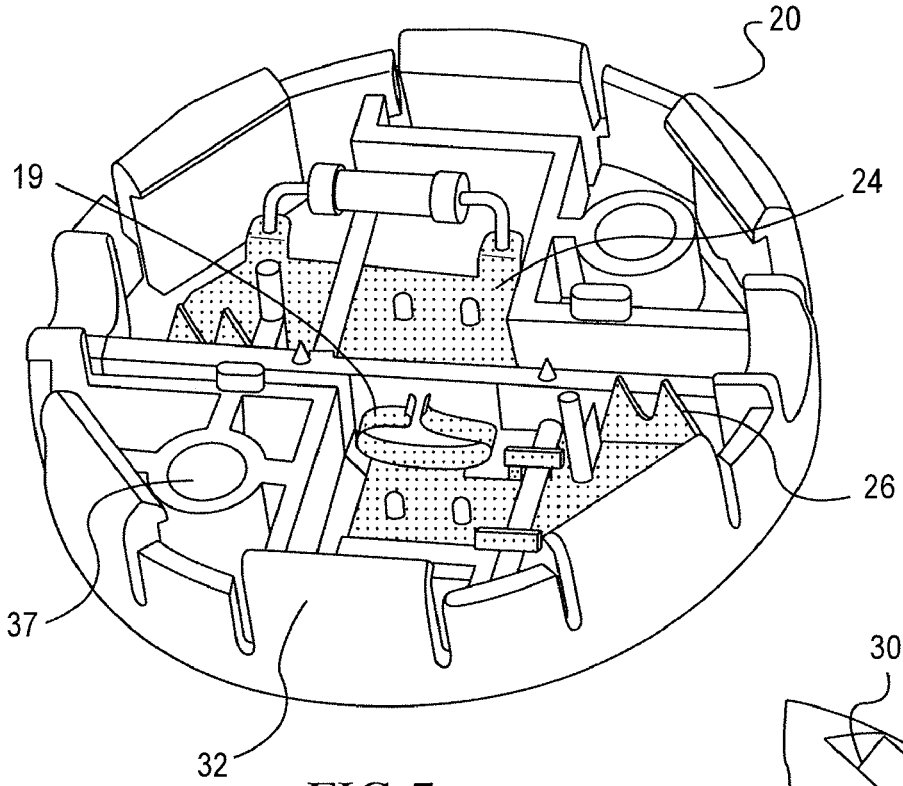
FIG. 7 is a perspective view of an LCD base for the LCD socket.
Figure 9:
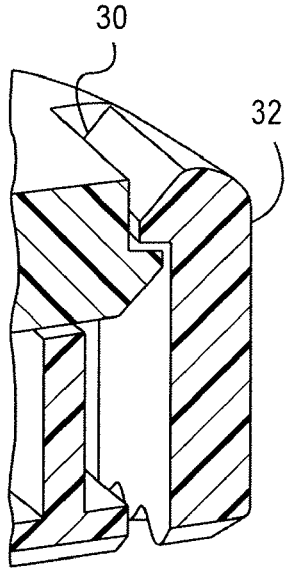
FIG. 9 is a partial view of a portion of the LCD socket.
Figure 8:
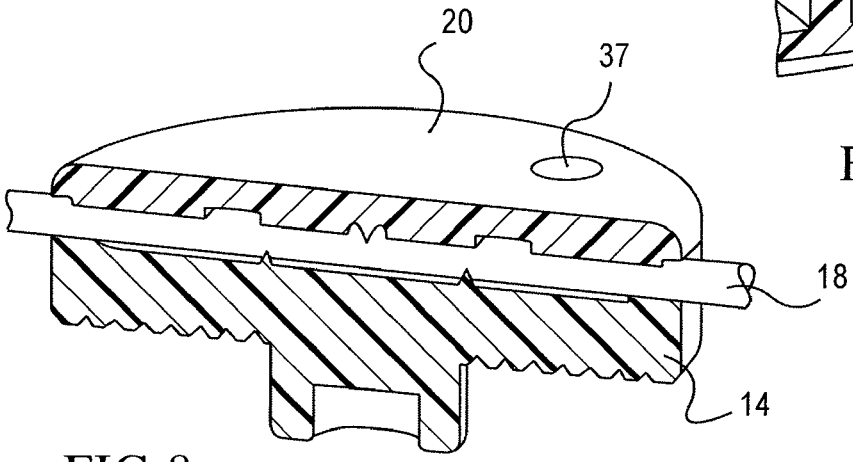
FIG. 8 is a perspective cross-sectional view of the LCD socket.

FIGS. 1-9 depict an LED socket 10 with an LED lamp 12. The LED socket 10 of, e.g., 9 mm in height and 36 mm in diameter, has a socket base 14 with grooves 16 for coupling conductor wires 18 (e.g., 18 AWG stranded wires on 2.54 mm [0.100"] center lines), and a socket cover 20 for mating with the socket base 14. A lamp holder 22 of, e.g., 11 mm in diameter and 5 mm in height, protrudes over and forms an integral part of the socket base 14 for retaining the LED lamp 12, and allowing electrical connection between the LED lamp and wires 18. Detents 15 in the lamp holder 22 have guide tabs 17 mounted therein to facilitate installation of the LED lamp 12, and to retain the LED lamp 12 within the LED sockets 10.

The LED socket 10 also has a metal plate 24 with pointed portions 26 mounted in the socket base 14 for piercing the wires 18, and for providing an electrical connection between the LED lamp 12 and wires 18. The metal plate 24 also has a leg contact 19 for electrical connection thereof with the LED lamp 12. The grooves 16 are set to retain wires 18 prior to field termination, thereby allowing rapid assembly of the LED socket 10. No tools are needed or required to install the LED socket 10 or the LED lamp 12.

The perimeter of the socket cover 20 is partitioned to include ribs 28 and notches 30 for facilitating mounting thereof to the socket base 14. Particularly, snap latches 32 from the perimeter of the socket base 14 are used to latch onto the corresponding notches 30 of the socket cover 20 to insure positive assembly thereof and prevent wire strain. The parameter of the socket cover 20 can also be supplemented with a waterproof adhesive to further enhance installation of the socket cover 20 to the socket base 14 to allow outdoor or wet location use. The combination of notches 30 and snap latches 32 ensures that the pointed portions 26 in, e.g., the form of insulation piercing contacts having 2 pins for each conductor, maintain a positive contact with the wires 18, thereby allowing excellent electrical conduction between the metal plate 24 and wires 18.

Moreover, the outer surface of the socket cover 20 can be affixed with a user logo, and the inner surface of the socket cover 20 is affixed with one or more pinch guides 34 to keep wires 18 resistant to axial pull, while minimizing force required to mount the socket cover 20 to the socket base 14. Either the socket base 14 or socket cover 20, or both, can be molded using Matte black or white or any other color desired.

A current control device 36, such as a resistor, is implemented and connected to the metal plate 24 to limit current flowing from the wires 18 to the LED lamp 12. The current control device 36 can be factory installed to a user specification.

To secure the LED socket 10 onto an external surface or material, such as hard surface or fabric material, an adhesive can be applied to one end of the socket cover for attachment thereto. Holes 37 (e.g., #6 screw mounting hole) through the socket base 20 and socket cover 14 can be used to facilitate the installation of the LED socket 10 to the external surface or material through, e.g., one or more screws (not shown). Molded grooves 39 on the LED socket allows for better adhesion when attached to the material.

The extended base of the LED socket 10 allows for an extensive contact area for hook and loop attachment or gluing thereof to a fabric material. The positioning of each LED socket on the external surface or material is dependent on an adjustable spacing between the sockets. The LED socket 10 can be made from plastic resin or other suitable substitutes. When attaching the LED socket 10 to the fabric material, the lamp holder 22 can be extended through the material to allow easy replacement of the LED lamp 12 when needed.

Figure 10:
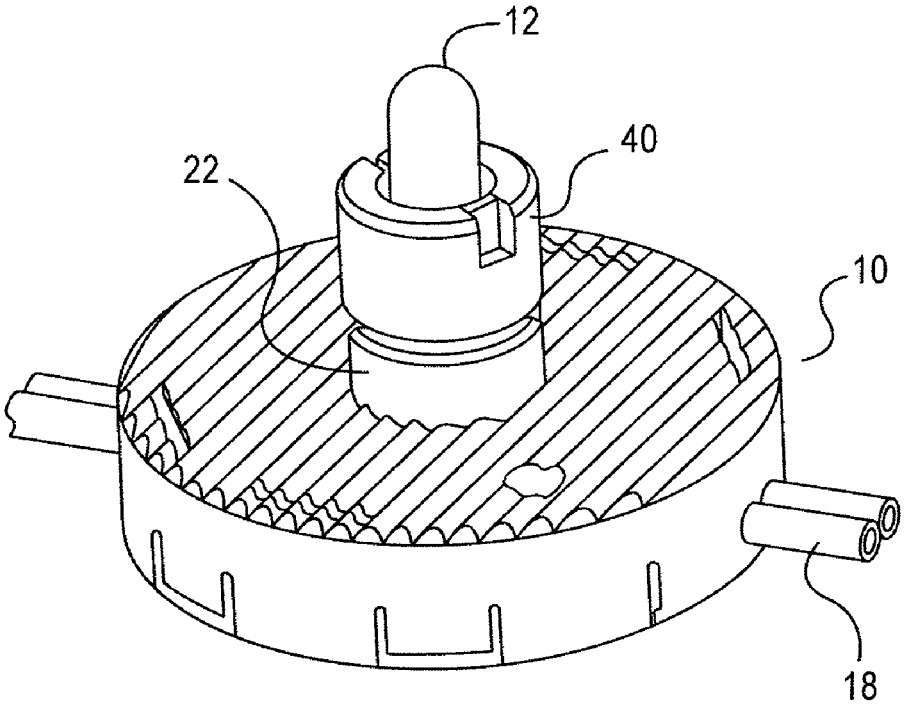
FIG. 10 is a perspective view of an LCD socket according to another embodiment.
Figure 11:
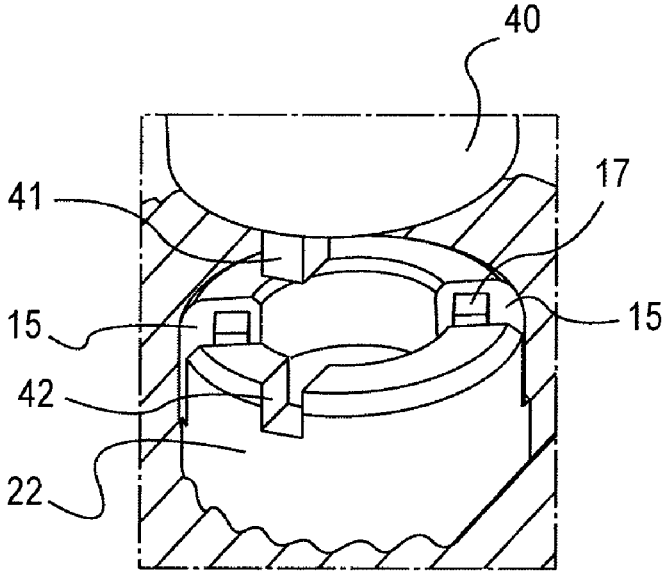
FIG. 11 is a partial perspective view on a portion of the LCD socket of FIG. 10.

In another embodiment as shown in FIGS. 10 and 11, the LED socket 10 has a lamp spacer 40 detachably mounted on the lamp holder 22 for extending and retaining the LED lamp 12. The spacer 40 also has detents 15 in the lamp holder 22 with guide tabs 17 mounted therein to facilitate installation of the LED lamp 12, and to retain the LED lamp 12 within the LED sockets. A key 41 mounted underneath the lamp spacer 40 is used to mate with a slot 42 on the lamp holder 22 to further assist the alignment thereof between the lamp spacer 40 and lamp holder 22. The spacer 40 incorporates guide holes (not shown) to allow for a smooth insertion of leads from the LED lamp 12 through the LED socket 10, and the subsequent mating thereof with wires 18. Specifically, the cathode lead from the LED lamp 12 is inserted into the guide hole adjacent to the key 41 so that the proper polarity can be established with the LED socket 10.

Figure 12:
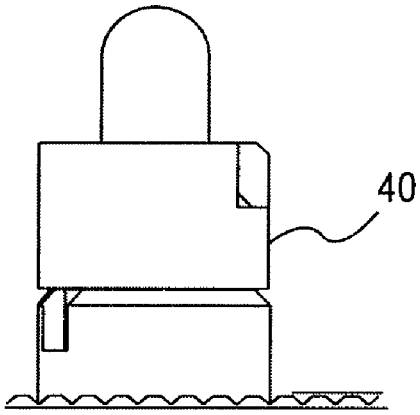
FIG. 12 is a partial front view of the LCD socket of FIG. 10.
Figure 13:
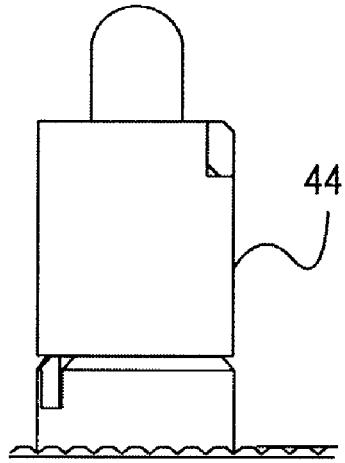
FIG. 13 is a partial front view of an LCD socket according to yet another embodiment.

FIGS. 12-13 depict the spacer 40 of one length in contrast with another spacer 44 of a different length to accommodate the differing LED lengths. For instance, the lamp holder 22 without the spacers 40 and 44 can accommodate an LED lamp of 6.80 mm in contact leg length. With the spacer 40 added, the LED socket 10 can further accommodate an LED lamp of 13.80 mm in contact leg length, and the leads of the LED lamp can be smoothly guided through the spacer 44 into the contacts of the LED socket 10. By replacing the spacer 40 with spacer 44, LED socket 10 can change its accommodation to include an LED lamp of 20.05 mm in contact leg length, while also smoothly guiding the leads of the LED lamps through the spacer 44 into the contacts of the LED sockets 10. The two spacers 40 and 44 can be stacked or bonded together to form one single spacer when needed.

Figure 14:
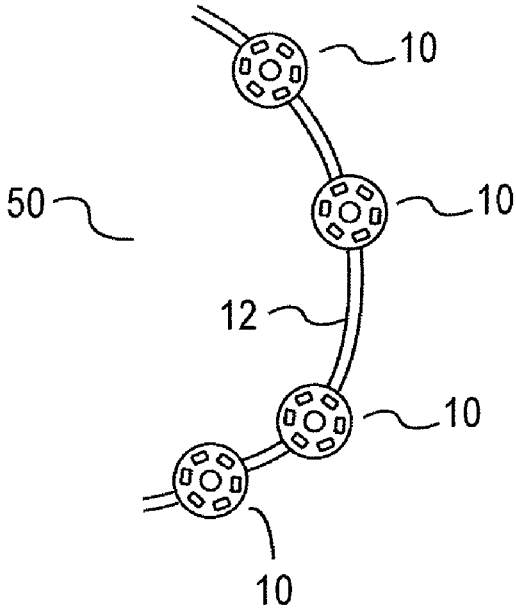
FIG. 14 is a perspective view of an LCD socket string.

FIG. 14 illustrates an LED socket string 50, which incorporate two of more of the aforementioned LED sockets 10 with a random spacing therebetween. The adjustable spacing between the LED sockets 10 can be set based on a user specification or input. One end of the wires in the LED socket string 50 is capped for insulation, while the other end of the wires in the LED socket string 50 is mounted with a connector for electrical connection thereof to a power supply.

The LED socket string 50 can be manufactured by a method of assembling socket bases 14 to corresponding socket covers 20 to form a plurality of LED sockets 10 with one or more wires 18 affixed therebetween, and securing LED lamps 12 to the LED sockets 10, whereby each of the LED sockets 10 includes a lamp holder 22 for detachably retaining the LED lamp 12. The adjustable spacing between the LED sockets 10 is determined based on a predetermined condition or user specification. One or more lamp spacers 40 can be used to further retain and extend corresponding LED lamps 12.

The present invention has been explained above with reference to a number of exemplary embodiments. As will be apparent to the person skilled in the art, various modifications and amendments can be made without departing from the scope of the present invention, as defined in the appended claims.

The invention claimed is:

1. An LED socket with an LED lamp having one or more leads, comprising:

a socket base with one or more grooves for coupling one or more wires, wherein said socket base includes a lamp holder for detachably retaining said LED lamp;

a socket cover for mating with said socket base, wherein said socket cover includes one or more ribs for facilitating mounting thereof to said socket base, and one or more pinch guides for keeping said wires resistant to axial pull while minimizing force required to mount said socket cover to said socket base with said wires therebetween; and a lamp spacer detachably mounted on said lamp holder for extending and retaining said LED lamp, wherein said lamp spacer guides said leads through said lamp spacer and into said LED sockets, thereby allowing electrical contact between said leads and said wires.

2. The LED socket of claim 1, further comprising a metal plate with one or more pointed portions mounted in said socket base for piercing said wires and providing an electrical connection between said LED lamp and said wires.

3. The LED socket of claim 2, further comprising a current control device connected to said metal plate to limit current.

4. The LED socket of claim 1, wherein said socket base and said socket cover include one or more corresponding holes to facilitate mounting of said LED socket to an external surface.

5. The LED socket of claim 1, wherein said LED socket is made of plastic resin.

6. The LED socket of claim 1, wherein a mounting position of said LED socket on said wires is determined based on an adjustable spacing between two or more of said sockets.

7. The LED socket of claim 1, wherein said mating is accomplished through one or more latches at a perimeter of said LED socket.

8. The LED socket of claim 1, wherein one end of said socket cover is covered with an adhesive to facilitate mounting of said LED socket to an external surface or material.

9. An LED socket string with LED lamps and one or more integrally mounted LED sockets, the string comprising a plurality of LED sockets with a adjustable spacing therebetween, each of said LED sockets being comprised of:

a socket base with one or more grooves for coupling one or more wires, wherein said socket base includes a lamp holder for detachably retaining said LED lamp;

a socket cover for mating with said socket base, wherein said socket cover includes one or more ribs for facilitating mounting thereof to said socket base, and one or more pinch guides for keeping said wires resistant to axial pull while minimizing force required to mount said socket cover to said socket base with said wires therebetween; and a lamp spacer detachably mounted on said lamp holder for extending and retaining said LED lamp, wherein said lamp spacer guides said leads through said lamp spacer and into said LED sockets, thereby allowing electrical contact between said leads and said wires.

10. The LED socket string of claim 9, further comprising a metal plate with one or more pointed portions mounted in said socket base for piercing the wires and providing an electrical connection between said LED lamp and said wires.

11. The LED socket string of claim 9, wherein said adjustable spacing between said LED sockets is determined based on a user specification.

12. The LED socket string of claim 10, further comprising a current control device connected to said metal plate.

13. The LED socket string of claim 9, wherein said socket base and said socket cover include one or more corresponding holes to facilitate mounting of said LED socket to an external surface.

14. The LED socket string of claim 9, wherein said LED socket is made of plastic resin.

15. The LED socket string of claim 9, wherein said mating is accomplished through one or more latches at a perimeter of said LED socket.

16. The LED socket string of claim 9, wherein one end of said socket cover is covered with an adhesive to facilitate mounting of said LED socket to an external surface or material.

17. A method of assembling a plurality of LED sockets to form an LED socket string comprising:

assembling a plurality of socket bases to a plurality of socket covers to form said plurality of LED sockets with one or more wires affixed therebetween, wherein said socket cover includes one or more ribs for facilitating mounting thereof to said socket base, and one or more pinch guides for keeping said wires resistant to axial pull while minimizing force required to mount said socket cover to said socket base with said wires therebetween;

positioning each of said LED sockets on said wires based on an adjustable spacing therebetween; and securing a plurality of LED lamps to said plurality of LED sockets, wherein each of said LED sockets includes a lamp holder for detachably retaining an LED lamp and a lamp spacer detachably mounted on said lamp holder for extending and retaining said LED lamp.

18. The method of claim 17, wherein said adjustable spacing between said LED sockets is determined based on a user specification.

* * * * *